US006595386B2

(12) United States Patent
Vogel et al.

(10) Patent No.: US 6,595,386 B2
(45) Date of Patent: Jul. 22, 2003

(54) WET WIPE DISPENSING

(75) Inventors: Nathan Vogel, Sturgen Bay, WI (US); Scott R. Lange, Oshkosh, WI (US); Yung Huang, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/965,645

(22) Filed: Sep. 27, 2001

(65) Prior Publication Data

US 2003/0057223 A1 Mar. 27, 2003

(51) Int. Cl.[7] ..... A47K 10/42; B65H 1/04

(52) U.S. Cl. ..... 221/48; 206/494; 428/126; 221/49

(58) Field of Search ..... 221/48, 49, 50, 221/58, 47; 206/233, 812, 494; 493/356; 428/126

(56) References Cited

U.S. PATENT DOCUMENTS

| | | | | | |
|---|---|---|---|---|---|
| 4,299,693 | A | | 11/1981 | Paulson | 209/3 |
| 4,631,124 | A | | 12/1986 | Paulson | 209/3 |
| 5,035,331 | A | | 7/1991 | Paulson | 209/3 |
| 5,540,332 | A | | 7/1996 | Kopacz et al. | 206/494 |
| 5,716,691 | A | * | 2/1998 | Chan | 428/126 |
| D395,952 | S | | 7/1998 | Buczwinski et al. | D3/294 |
| 5,785,179 | A | | 7/1998 | Buczwinski et al. | 206/494 |
| 5,964,351 | A | | 10/1999 | Zander | 206/494 |
| 6,030,331 | A | | 2/2000 | Zander | 493/356 |
| 6,045,002 | A | * | 4/2000 | Wierschke | 221/48 |
| 6,168,848 | B1 | * | 1/2001 | Heath | 428/126 |
| D437,686 | S | | 2/2001 | Balzar et al. | D3/302 |
| 6,196,390 | B1 | | 3/2001 | Bando | 206/494 |
| 6,202,845 | B1 | | 3/2001 | Hill | 206/449 |
| 6,213,344 | B1 | | 4/2001 | Hill | 221/38 |
| 6,269,970 | B1 | | 8/2001 | Huang et al. | 220/836 |
| 6,286,712 | B1 | * | 9/2001 | Craig | 221/48 |
| 6,299,016 | B1 | * | 10/2001 | Bando et al. | |
| 2002/0039638 | A1 | * | 4/2002 | Bando | 428/126 |

FOREIGN PATENT DOCUMENTS

| | | | | |
|---|---|---|---|---|
| CA | 470433 | * | 1/1951 | 206/57 |
| EP | 0983739 | | 3/2000 | A47K/10/42 |

* cited by examiner

*Primary Examiner*—Donald P. Walsh
*Assistant Examiner*—Daniel K Schlak
(74) *Attorney, Agent, or Firm*—Schwegman, Lundberg, Woessner & Kluth, P.A.

(57) ABSTRACT

Stacks of wet wipes having improved dispensability are provided. The stacks comprise a first clip of wet wipes and a second clip of wet wipes positioned on top of the first clip of wet wipes. Clips of wet wipes generally include a last wet wipe comprising a bottom portion having a surface area that is greater than the surface area of the top portion. Clips of wet wipes also generally include a next-to-last wet wipe comprising a bottom portion having a surface area that is less than the surface area of the top portion. Individual wet wipes in stacks of the present invention have less tendency to stick together than wet wipes in stacks found in the prior art.

33 Claims, 8 Drawing Sheets

WET WIPE DISPENSING

BACKGROUND OF THE INVENTION

Wet wipes are well known commercial consumer products that are available in many forms. Commonly, wet wipes are provided as a stack of rectangular-shaped, moistened sheets packaged in a plastic container. Conventional wet wipes have been made from a variety of materials and have been moistened with a variety of suitable wiping solutions. Wet wipes can be used as baby wipes, hand wipes, household cleaning wipes, industrial wipes, and the like.

Conventional wet wipes are available in either folded or unfolded configurations. For example, stacks of wet wipes have been available wherein each of the wet wipes in the stack has been arranged in a folded configuration, such as a c-folded, z-folded, or quarter-folded configuration. Wet wipes in stacks of folded wet wipes have been interfolded with the wet wipes immediately above and below in the stack of wet wipes. Additionally, wet wipes have been provided in the form of continuous webs of material that include perforations to separate the individual wet wipes and that are wound into rolls and packaged in plastic containers.

Typically, the stacks of wet wipes have been designed to provide one-at-a-time dispensing, which can be accomplished using a single hand. Such single-handed, one-at-a-time dispensing, is particularly desirable because the other hand of the user is typically required to be simultaneously used for other activities. For example, when changing a diaper product on an infant, the user typically uses one hand to hold and maintain the infant in a desired position while the other hand is searching for a wet wipe to clean the infant.

However, the dispensing of wet wipes that have been folded and arranged in stacks has not been completely satisfactory. For example, on occasion two wet wipes will stick together upon dispensing, causing the user to use two hands and waste time using the product. This inconsistency in the products dispensability can reduce the appeal of the product to the consumer. Thus, there remains a need in the industry to provide wet wipes having improved dispensability.

SUMMARY OF THE INVENTION

The present invention addresses one or more of the issues discussed and provides for wet wipes having improved dispensability. It has been discovered that in stacks of conventional wet wipes comprising multiple clips of z-folded wet wipes, the adhesion between the last wet wipe of one clip and the first wet wipe of the next clip is significantly less than the adhesion between wet wipes within the same clip. This difference in adhesion levels too often causes the last wet wipe of the first clip to adhere to the next-to-last wet wipe as the next-to-last wet wipe is being dispensed by the user. The present invention provides for more uniform adhesion between the individual wet wipes in stacks of z-folded wet wipes, improving the dispensability of the z-folded wet wipes.

The present invention can provide for increased adhesion between the last wipe in a clip and the first wipe in the next clip or increased adhesion between the last wipe in a clip and the bottom of a container housing the clip. The present invention can also provide for decreased adhesion between the next-to-last wipe in a clip and the last wipe in a clip. Thus, the present invention reduces the number of times the last wipe in a clip sticks to the next-to-last wipe in a clip when the next-to-last wipe is dispensed.

In one aspect, the present invention provides a clip of z-folded wet wipes. Generally, the last wipe in a clip according to the present invention comprises a bottom portion that has a surface area greater than the surface area of the top portion. Typically, the bottom portion of the last wipe will have a surface area greater than about 55 percent of the surface area of the center portion. In one aspect, the bottom portion of the last wipe has a surface area greater than about 65 percent of the surface area of the center portion. In another aspect, the bottom portion of the last wipe has a surface area about 75 percent of the surface area of the center portion. Also, the top portion of the last wipe in a clip typically will have a surface area less than about 45 percent of the surface area of the center portion. In one aspect, the top portion of the last wipe has a surface area less than about 35 percent of the surface area of the center portion. In another aspect, the top portion of the last wipe has a surface area that is about 25 percent of the surface area of the center portion.

Generally, the next-to-last wipe in a clip according to the present invention comprises a bottom portion that has a surface area less than the surface area of the top portion. Typically, the bottom portion of the next-to-last wipe will have a surface area less than about 45 percent of the surface area of the center portion. In one aspect, the bottom portion of the last wipe has a surface area less than about 35 percent of the surface area of the center portion. In another aspect, the bottom portion of the next-to-last wipe has a surface area about 25 percent of the surface area of the center portion. Also, the top portion of the next-to-last wipe in a clip typically will have a surface area greater than about 55 percent of the surface area of the center portion. In one aspect, the top portion of the next-to-last wipe has a surface area greater than about 65 percent of the surface area of the center portion. In another aspect, the top portion of the next-to-last wipe has a surface area that is about 75 percent of the surface area of the center portion.

In one aspect, the present invention provides a stack of z-folded wet wipes. Stacks of wet wipes according to the present invention can be produced by positioning a first clip of z-folded wet wipes on top of a second clip of z-folded wet wipes. The clips utilized to produce stacks of wet wipes according to the present invention can be those clips described above.

DESCRIPTION OF THE DRAWINGS

The present invention is illustrated by way of example in the following drawings in which like references indicate similar elements. The following drawings disclose various aspects of the present invention for purposes of illustration only and are not intended to limit the scope of the invention.

DETAILED DESCRIPTION OF THE INVENTION

In the following detailed description of the present invention, reference is made to the accompanying Drawings, which form a part hereof, and in which are shown by way of illustration specific aspects in which the present invention may be practiced. It should be understood that other aspects may be utilized and structural changes may be made without departing from the scope of the present invention.

The present invention provides for stacks of wet wipes having improved dispensability. As used herein, the term "stack" and "stacked configuration" refers to any collection of wet wipes wherein there is a plurality of surface-to-surface interfaces between the wet wipes.

Figure 1:
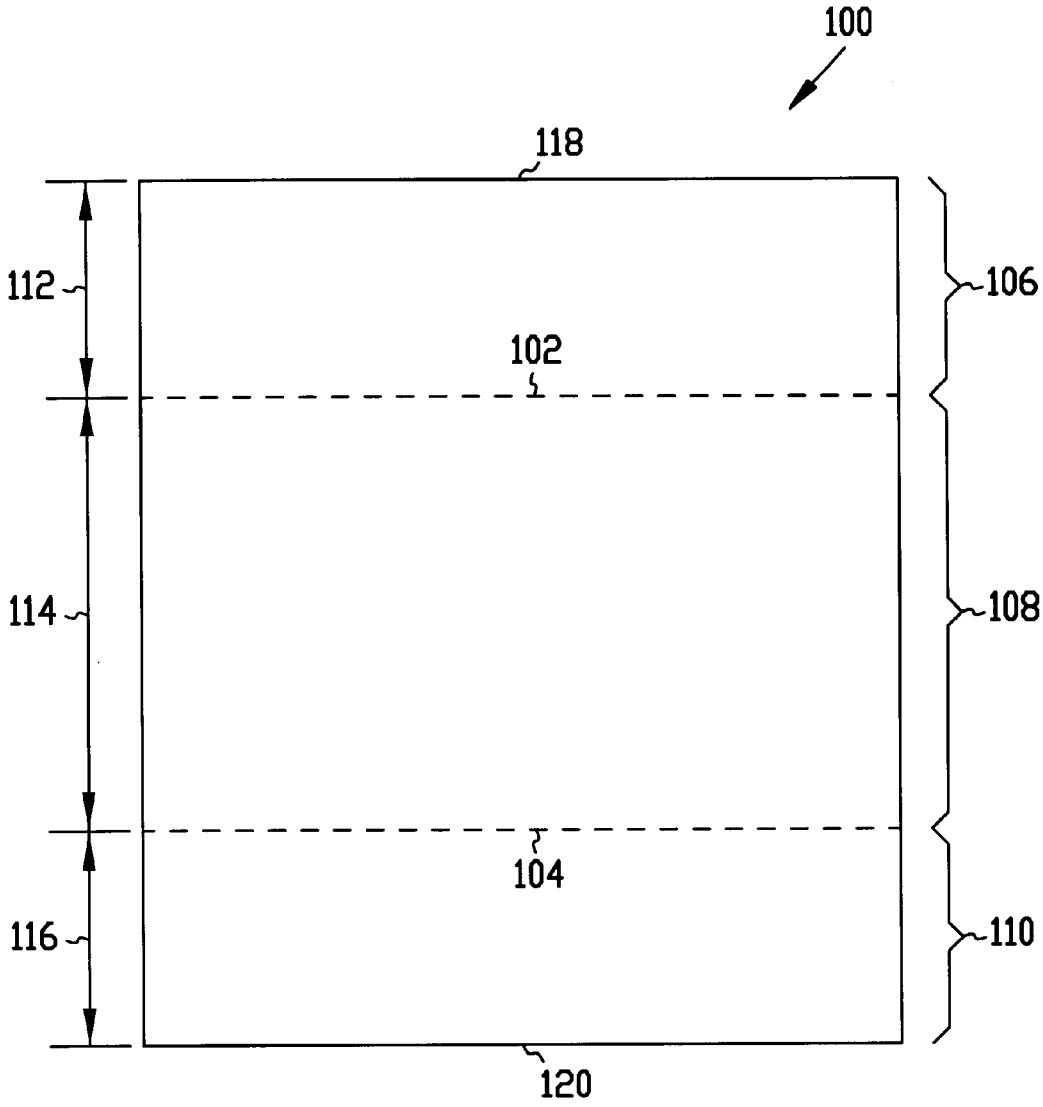
FIG. 1 illustrates an example of an unfolded wet wipe.

Commonly, wet wipes have a rectangular shape, but the present invention is not so limited. It is within the scope of the present invention of have wet wipes having other shapes. FIG. 1 illustrates an individual wet wipe 100 that is in an unfolded configuration. Wet wipe 100 defines a pair of opposite end edges 118 and 120 which may be referred to as the leading end edge 118 and the trailing end edge 120. The leading edge 118 may also be referred to as the top edge 118. The leading edge 118 is the edge of the wet wipe that is exposed to the user when wet wipe 100 is positioned at the top of a stack of wet wipes. Typically, wet wipes are dispensed by the user grabbing the leading edge of the wet wipe positioned at the top of a stack of wet wipes.

Figure 2:
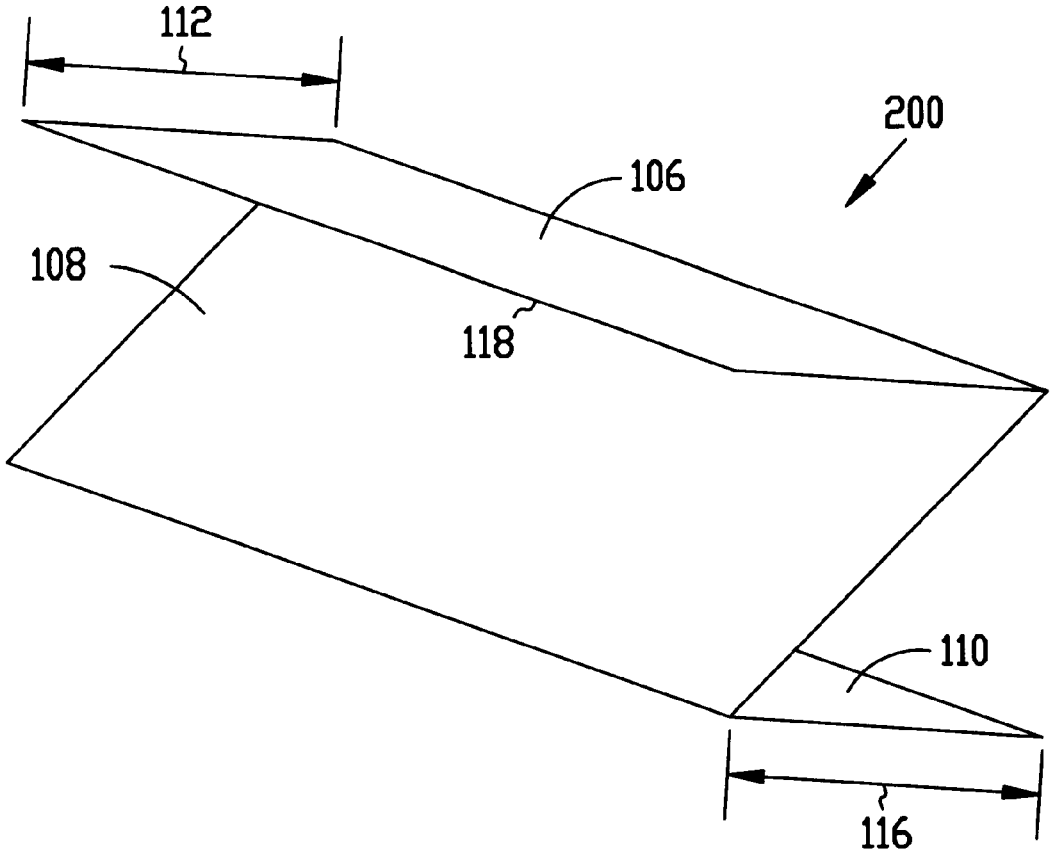
FIG. 2 illustrates an example of a z-folded wet wipe.

Wet wipe 100 is folded along fold lines 102 and 104 to produce a z-folded configuration as shown in FIG. 2. Folding wet wipe 100 along fold lines 102 and 104, partitions wet wipe 100 into three portions: a top portion 106, a central portion 108, and a bottom portion 110. The top portion (and therefore, the leading edge) of a wet wipe is exposed to the user when the wet wipe is positioned at the top of a stack of wet wipes. The bottom portion of a wet wipe is in contact with the next wet wipe in a stack of wet wipes, unless of course, the wet wipe happens to be the last wet wipe in the stack.

When a wet wipe is rectangular as is wet wipe 100, then the top portion, central portion, and bottom portion will also typically be rectangular. The distance between fold 102 and leading edge 118 is referred to herein as the width of the top portion 112. The distance between fold 102 and fold 104 is referred to herein as the width of the central portion 114. The distance between fold 104 and the trailing edge 120 is referred to herein as width of the bottom portion 116. The surface area of a wet wipe's top portion, central portion, and bottom portion can be determined using any means know for measuring the area of a geometric shape. For example, the surface area of top portion 106 can be calculated by multiplying the width 112 of top portion 106 by the length of leading edge 118. If the top portion of a wet wipe is not rectangular, other means for determining the surface area can be advantageously utilized. Determining the surface area of a wet wipe's top portion, central portion, and bottom portion can be readily accomplished using conventional techniques without undue experimentation.

Materials suitable for the wet wipes of the present invention are well known to those skilled in the art. Wet wipes useful in the present invention can be made from any material suitable for use as a moist wipe, including meltblown, coform, air-laid, spunlace, spunbond, bonded-carded web materials, hydroentangled materials and the like and can comprise synthetic or natural fibers or combinations thereof. Wet wipes useful in the present invention may have a basis weight of from about 25 to about 120 grams per square meter and desirably from about 40 to about 90 grams per square meter. In a particular aspect, the wet wipe is a coform basesheet of polymeric microfibers and cellulosic fibers having a basis weight of from about 60 to about 80 grams per square meter and desirably about 75 grams per square meter. Such coform basesheets can be manufactured generally as described in: U.S. Pat. No. 4,100,324 issued to Anderson et al., U.S. Pat. No. 5,508,102 issued to Georger et al., and U.S. Pat. No. 5,385,775 issued to Wright, all which are herein incorporated by reference. In another particular aspect, the wet wipe is a composite material including one or more, and advantageously two, coform basesheet layers as just described and which sandwich between them an elastomeric layer (e.g., of elastic film, elastic fibers or filaments, elastic web, or a combination of one or more of these and similar structures). Such composite material can be manufactured generally as described in: U.S. patent application Ser. No. 09/751,329 filed Dec. 29, 2000 of inventors Lange et al., U.S. Pat. No. 4,720,415 issued to Vander Wieland et al., and U.S. Pat. No. 5,385,775 issued to Wright, all which are herein incorporated by reference.

Wet wipes according to the present invention and stacks of wet wipes according to the present invention contain a liquid. The liquid can be any solution that can be absorbed into the wet wipes. The liquid contained within the wet wipes may include any suitable components that provide the desired wiping properties. For example, the components may include water, emollients, surfactants, preservatives, chelating agents, pH buffers, or combinations thereof. The liquid may also contain lotions and/or medicaments. The amount of liquid contained within wet wipes may vary depending upon the type of material being used to provide the wet wipe, the type of liquid being used, the type of container being used to store the stack of wet wipes, and the desired end use of the wet wipe. Generally, each wet wipe can contain from about 150 to about 600 weight percent and desirably from about 250 to about 450 weight percent liquid add-on based on the dry weight of the wipe. The amount of liquid contained within wet wipe made from a coform material comprising from about 30 to about 40 weight percent polymeric microfibers based on the dry weight of the wipe is generally from about 300 to about 400 weight percent and desirably about 330 weight percent liquid add-on based on the dry weight of the wipe.

Accordingly, a stack of wet wipes may include from about 150 to about 600 weight percent, desirably from about 250 to about 450 weight percent, and more desirably from about 300 to about 400 weight percent of the liquid based on the dry weight of the stack of wipes. If the amount of liquid is less than the above-identified range, the wet wipe may be too dry and may not adequately perform. If the amount of liquid is greater than the above-identified range, the wet wipe may be oversaturated and soggy and the liquid may pool in the bottom of the container.

Wet wipes and stacks of wet wipes according to the present invention may be manufactured using several different processes well known to those skilled in the art. The particular method and sequence of steps described herein is not a limitation to the present invention, but is disclosed only as one method of producing wet wipes, clips of wet wipes, and stacks of wet wipes. Initially, a supply roll of the material being converted into the wet wipe is unwound to provide a continuously moving web of material. The web of material is saturated or otherwise impregnated with a liquid, such as those described above, by any suitable means such as spraying, dipping, or the like as are well known to those skilled in the art. In a particular aspect, the web of material is passed over several perforated tubes that exude the liquid into the material. The add-on amount of liquid can be any amount that produces the desired wet wipe and stack of wet wipes.

The web of material is slit in the machine direction into multiple ribbons, each of which may be folded into the type of fold desired for the individual wet wipe. The web of material may be slit using a cutter that produces straight edges. Alternately, the web of material may be slit using a cutter that configures at least a portion of one of the edges of each of the multiple ribbons of material in a non-linear pattern, such as a sine wave pattern or zig-zag pattern (for example, as taught in U.S. Pat. No. 5,540,332 issued to Kopacz et al., herein incorporated by reference). In one aspect, the web of material is slit into eight ribbons. The ribbons of material may then be folded into a folded configuration. According to the present invention, each ribbon of material is folded into a folded configuration, defining a top portion, a central portion, and a bottom portion as explained above and illustrated in FIG. 1 and FIG. 2.

Figure 3:
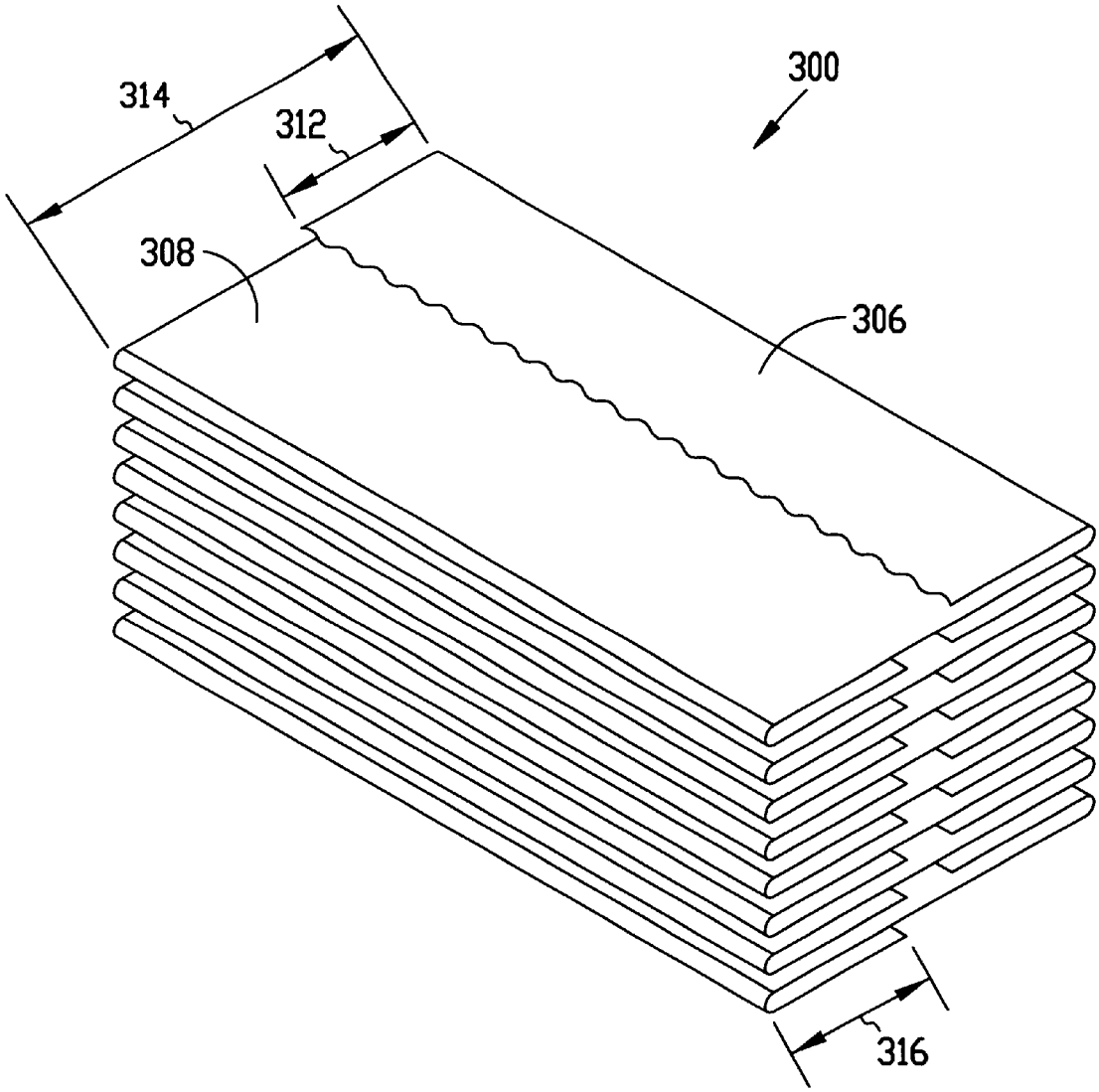
FIG. 3 illustrates an example of a stack of z-folded wet wipes.

Each folded ribbon may then be combined, one ribbon on top of the other, with the other folded ribbons from the same web of material to form a continuous "sausage." The sausage is then cut into "clips" of wet wipes. Each clip will typically contain eight wet wipes. An example of a clip 300 containing eight wet wipes is illustrated in FIG. 3. FIG. 3 shows the top portion 306 having width 312 and central portion 308 having width 314 of the first or topmost wet wipe in clip 300. Width 312 is approximately 50 percent as wide as width 314 and is approximately equal to the width 316 of the bottom portion of the last or bottommost wet wipe in clip 300. Accordingly, the surface area of top portion 306 is approximately equal to 50 percent of the surface area of central portion 308 and is approximately equal to the surface are of the bottom portion 316. Clips of wet wipes are arranged in a stacked configuration to form at least one stack of wet wipes. The number of clips in a stack depends on the desired number of stacks and the number of wet wipes in the final package. For example, for an 80-count package having one stack, ten clips of eight wet wipes apiece would be required to form a single stack of 80 wet wipes.

Figure 4:
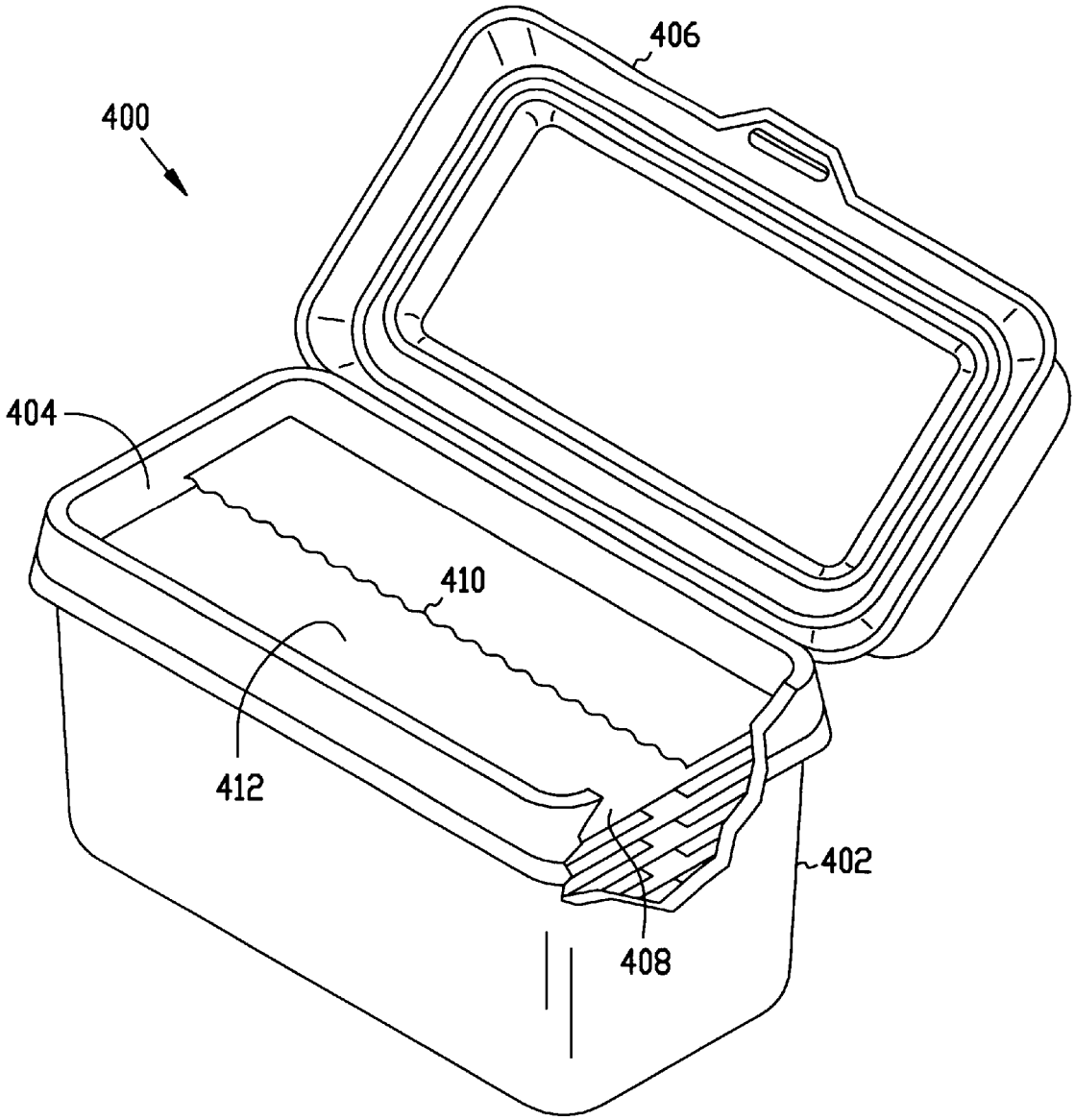
FIG. 4 illustrates a partially cut away view of an example of a package of wet wipes.

After a stack of wet wipes is properly configured, at least one stack of wet wipes may be placed in the interior of a container, such as a plastic tub, bag, pouch or other sealable rigid to flexible structure, to provide a package of wet wipes. As representatively illustrated in FIG. 4, a package of wet wipes 400 typically includes a tub container 402, defines an interior 404, and includes a reclosable top 406. The container 402 provides a substantially hermetically sealed environment for at least one stack of wet wipes 408 to minimize the escape of any liquid there from. The reclosable top 406 can be selectively opened and closed by the user to provide access to the stack of wet wipes 408.

In use, the user can open the package of wet wipes 400 by lifting the reclosable top 406 of the container 402. After opening the reclosable top 406, the user can selectively drag one or more fingers across the top of the stack of wet wipes 408 to peelingly lift the leading edge 410 of the top wet wipe 412 from the stack of wet wipes 408. After dispensing one or more wet wipes, the user can close the reclosable top 406 to minimize the escape of any liquid. Generally, as long as the user maintains the reclosable top 406 in the closed position when not using the wet wipes, the wet wipes retain a sufficient amount of liquid.

It has been discovered that in stacks of conventional wet wipes comprising multiple clips of z-folded wet wipes folded in substantially the same manner, the average adhesion level between the last wet wipe of one clip and the first wet wipe of the next clip is significantly less than the average adhesion level between wet wipes within the same clip. This difference in adhesion levels too often causes the last wet wipe of a clip to stick to the next-to-last wet wipe of the clip as the next-to-last wet wipe is being dispensed by the user. When the last wet wipe in a clip sticks to the next-to-last wet wipe, both wet wipes are often dispensed together, frequently forcing the user to use two hands to separate the wipes and waste time in utilizing the product or use two wipes instead of just one as is desired.

It has also been discovered that altering the surface area of the folded portions (that is, the top portion and bottom portion) on z-folded wet wipes in stacks of wet wipes can alter the adhesion levels between adjacent wet wipes in the stack. Accordingly, the present invention addresses deficiencies in the prior art by providing for stacks of wet wipes having adhesion levels between individual wet wipes that are more uniform than the adhesion levels found in the prior art. The more uniform adhesion levels of the present invention, provide for improved dispensability of the wet wipes.

For the purpose of further explanation, let W8 refer to the last wet wipe in a first clip of eight wet wipes and W7 refer to the next-to-last wet wipe in the first clip of eight wet wipes. Let W1 refer to the first wet wipe in a second clip of wet wipes on which the first clip has been stacked. Additionally, let Adhesion(7/8) refer to the adhesion level between W7 and W8 and let Adhesion(8/1) refer to the adhesion level between W8 and W1. Without wishing to be limited by any particular theory of operation, it is believed that if the difference between Adhesion(7/8) and Adhesion (8/1) (that is, Adhesion (7/8) minus Adhesion(8/1)) is greater than the weight of W8, then, as W7 is dispensed, a break will occur between W8 and W1 instead of W7 and W8. Consequently, W7 and W8 will be dispensed together. Conversely, it is believed that if the difference between Adhesion(7/8) and Adhesion(8/1) is less than the weight of W8, then, as W7 is dispensed, a break will occur between W7 and W8 so that W8 is not dispensed along with W7.

The present invention provides stacks of wet wipes, wherein the adhesion between the next-to-last wet wipe in a first clip and the last wet wipe in a first clip is substantially similar to the adhesion between the last wet wipe in the first clip and the first wet wipe in the second clip. If the two adhesion levels are sufficiently similar, then their difference will be less than the weight of the last wet wipe of the first clip, significantly decreasing the chance that the last wet wipe in a clip will stick to and inadvertently be dispensed with the next-to-last wet wipe in a clip.

In one aspect, the present invention increases the adhesion between the last wet wipe of a first clip (for example, W8 above) and the first wet wipe of a second clip (for example, W1 above). In another aspect, the present invention decreases the adhesion between the next-to-last wet wipe in a clip and the last wet wipe in a clip.

Figure 5:
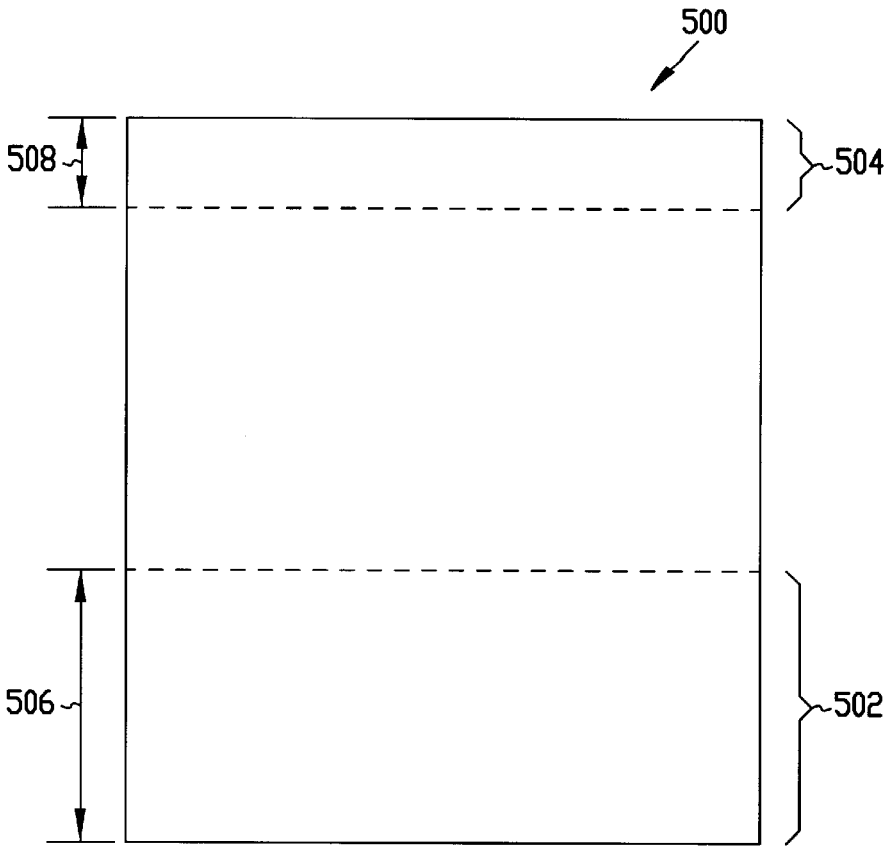
FIG. 5 illustrates an example of an unfolded wet wipe having a bottom portion wider than the top portion.
Figure 6:
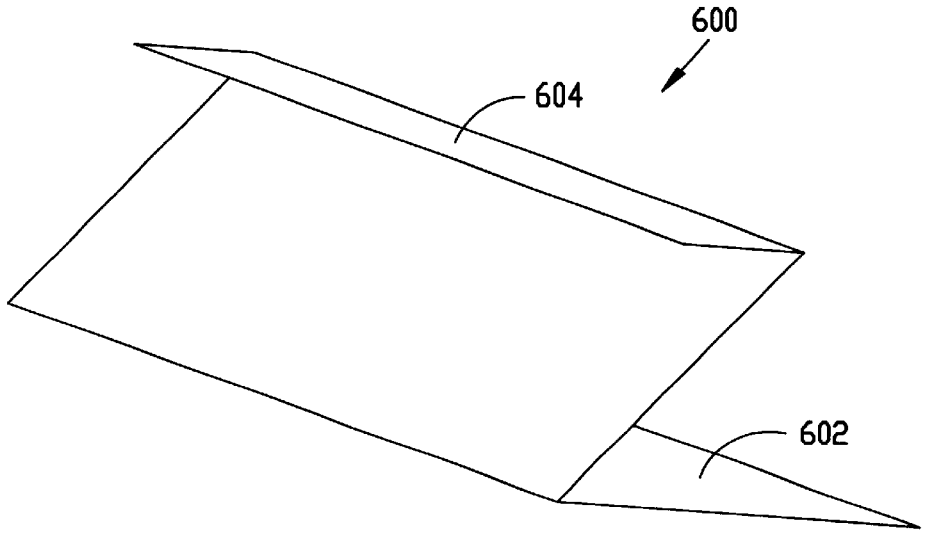
FIG. 6 illustrates an example of a z-folded wet wipe having a bottom portion wider than the top portion.

In a first aspect, the present invention provides a clip of z-folded wet wipes. Each wet wipe comprises a top portion having a surface area, a central portion having a surface area, and a bottom portion having a surface area. The last z-folded wet wipe (that is, the wet wipe positioned at the bottom of the clip) comprises a bottom portion having a surface area greater than the surface area of the top portion. An example of a last z-folded wet wipe is representatively illustrated in FIG. 5 and FIG. 6. In FIG. 5, wet wipe 500 has bottom portion 502 having a greater surface area than top portion 504. In FIG. 5, width 506 of bottom portion 502 is greater than width 508 of top portion 504. A wet wipe 600 folded in accordance with the present invention is representatively illustrated in FIG. 6. Wet wipe 600 has a bottom portion 602 having a greater surface area than the top portion 604. In a desirable aspect of the present invention the surface area of the last z-folded wet wipe's bottom portion is greater than about 55 percent of the surface area of the last z-folded wet wipe's central portion and the surface area of the last z-folded wet wipe's top portion is less than about 45 percent of the surface area of the central portion. In another desirable aspect of the present invention, the surface area of the last z-folded wet wipe's bottom portion is greater than about 65 percent of the surface area of the last z-folded wet wipe's central portion and the surface area of the last z-folded wet wipe's top portion is less than about 35 percent of the surface area of the central portion. In another desirable aspect of the present invention, the surface area of the last z-folded wet wipes' bottom portion is about 75 percent of the surface area of the last z-folded wet wipe's central portion and the surface area of the last z-folded wet wipe's top portion is about 25 percent of the surface area of the central portion.

Figure 7:
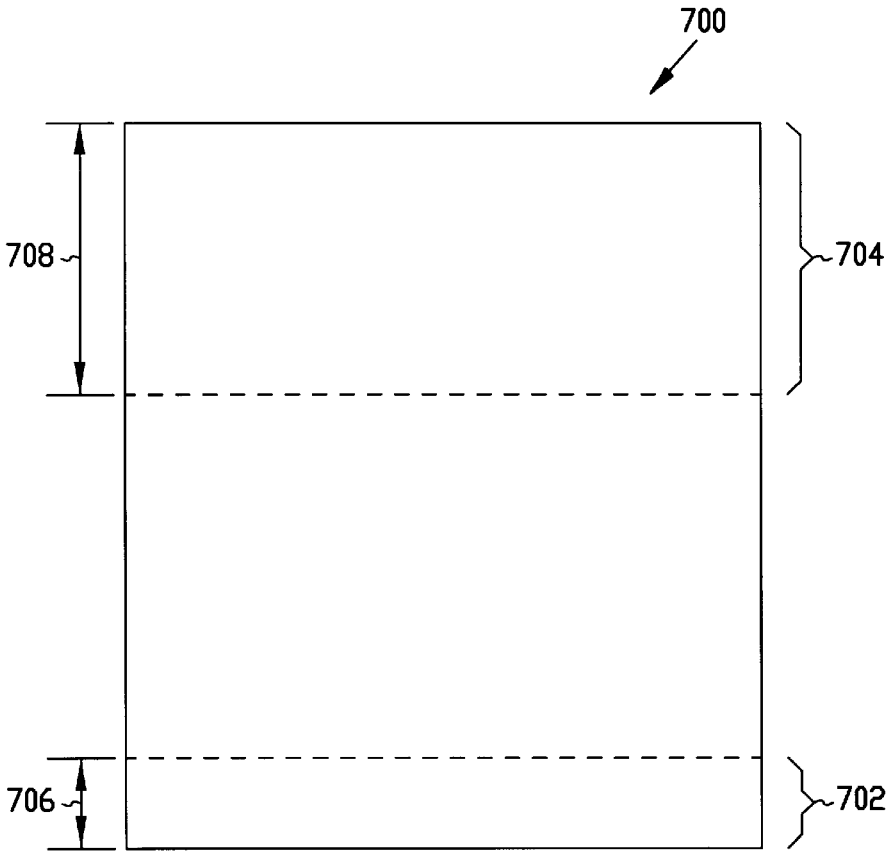
FIG. 7 illustrates an example of an unfolded wet wipe having a top portion wider than the bottom portion.
Figure 8:
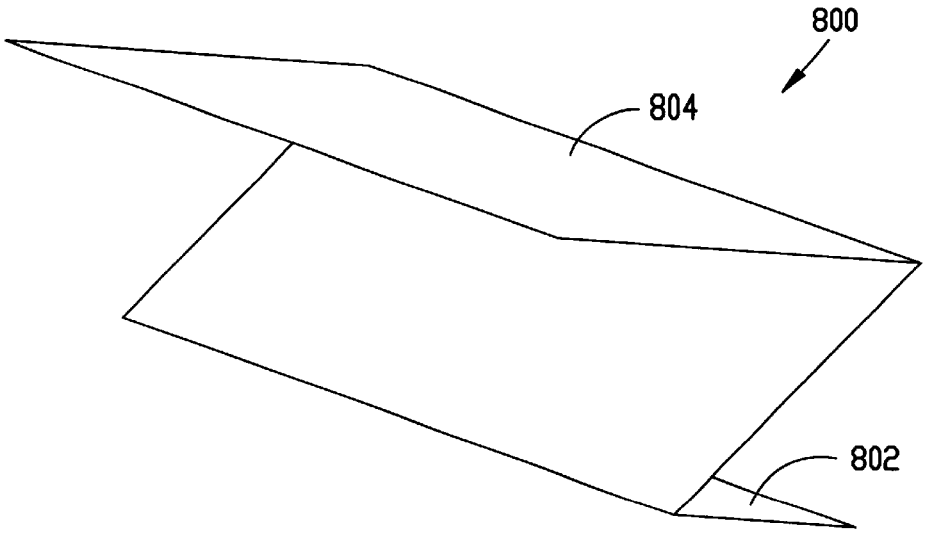
FIG. 8 illustrates an example of a z-folded wet wipe having a top portion wider than the bottom portion.

The next-to-last z-folded wet wipe in clips according to the present invention (that is, the wet wipe positioned on top of the last z-folded wet wipe) typically comprises a top portion having a surface area greater than the surface area of the bottom portion. An example of a next-to-last z-folded wet wipe is representatively illustrated in FIG. 7 and FIG. 8. In FIG. 7, wet wipe 700 has top portion 704 having a greater surface area than bottom portion 702. As illustrated in FIG. 7, the top portion 708 is greater than the bottom portion width 706. A wet wipe 800 folded in accordance with the present invention is representatively illustrated in FIG. 8. Wet wipe 800 has a top portion 804 that is wider than the bottom portion 802. In FIG. 7, width 708 of top portion 704 is greater than width 706 of bottom portion 702. In a desirable aspect of the present invention, the surface area of the next-to-last z-folded wet wipes' bottom portion is less than about 45 percent of the surface area of the next-to-last z-folded wet wipe's central portion and the surface area of the next-to-last z-folded wet wipe's top portion is greater than about 55 percent of the surface area of the next-to-last z-folded wet wipe's central portion. In another desirable aspect of the present invention, the surface area of the next-to-last z-folded wet wipes' bottom portion is less than about 35 percent of the surface area of the next-to-last z-folded wet wipe's central portion and the surface area of the next-to-last z-folded wet wipe's top portion is greater than about 65 percent of the surface area of the next-to-last z-folded wet wipe's central portion. In another desirable aspect of the present invention, the surface area of the next-to-last z-folded wet wipes' bottom portion is about 25 percent of the surface area of the next-to-last z-folded wet wipe's central portion and the surface area of the next-to-last z-folded wet wipe's top portion is about 75 percent of the surface area of the next-to-last z-folded wet wipe's central portion.

Figure 9:
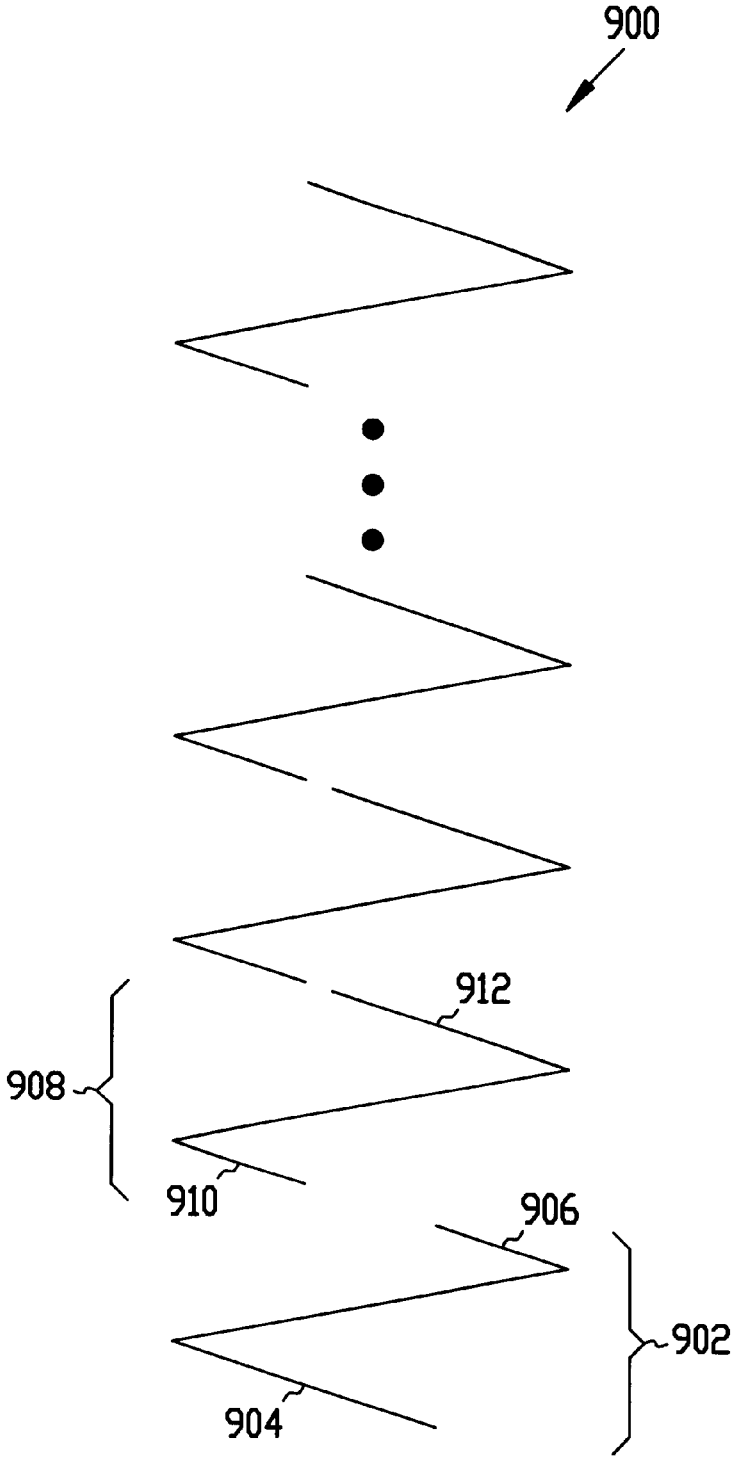
FIG. 9 illustrates an exploded view of an example of a clip of z-folded wet wipes.

FIG. 9 illustrates an example of a clip 900 according to the present invention. The last wet wipe 902 of clip 900 has a bottom portion 904 having a surface area greater than the surface area of the top portion 906. The next-to-last wet wipe 908 has a top portion 912 having a surface area that is greater than the surface area of the bottom portion 910.

As shown in FIG. 9, clips according to the present invention additionally comprise a plurality of adjacent z-folded wet wipes positioned on top of the next-to-last z-folded wet wipe, with each of the plurality of adjacent wet wipes folded in substantially the same manner. By folded in substantially the same manner, it is meant that all the top portions of the wipes in the plurality have approximately the same surface area and all the bottom portions have approximately the same surface area. In a desired aspect, the z-folded wet wipes in the plurality of adjacent wet wipes comprise a top portion and a bottom portion having surface areas that are about 50 percent of the surface area of the central portion.

Figure 10:
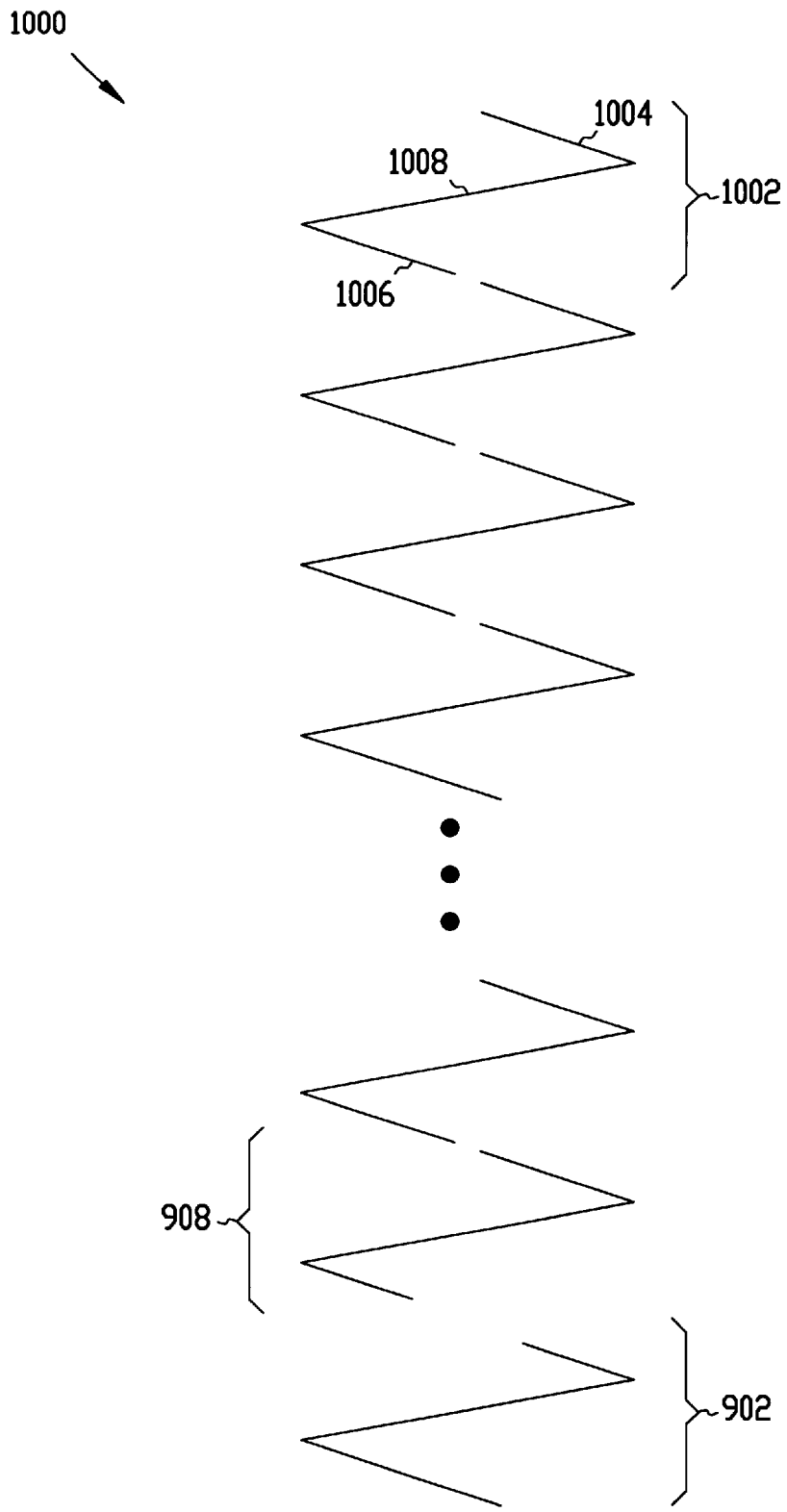
FIG. 10 illustrates an exploded view of an example of an alternate clip of z-folded wet wipes.

FIG. 10 illustrates another example of a clip 1000 according to the present invention. The last wet wipe 902 and the next-to-last wet wipe 908 in clip 1000 are identical to the last wet wipe 902 and the next-to-last wet wipe 908 of clip 900 in FIG. 9. The difference between clip 900 in FIG. 9 and clip 1000 in FIG. 10 is the plurality of adjacent z-folded wet wipes positioned on top of the next-to-last z-folded wet wipe. FIG. 10 illustrates a desired aspect of the present invention in that the plurality of adjacent wet wipes in clip 1000 all comprise a top portion and a bottom portion having surface areas that are about 50 percent of the surface area of the central portion. For example, in wet wipe 1002, the surface area of top portion 1004 is approximately equal to 50 percent of the surface area of central portion 1008 and the surface area of bottom portion 1006 is approximately equal to 50 percent of the surface area of central portion 1008.

Stacks of wet wipes can be produced in accordance with the present invention by stacking clips. If a first clip of wet wipes according to the present invention is positioned on top of another clip of wet wipes to form a stack of wet wipes, the bottommost z-folded wet wipe in the first clip (that is, the last wipe in the first clip) will be positioned on top of the topmost (that is, the first) wet wipe in the second clip with the bottom portion of the bottommost z-folded wet wipe in the first clip being adjacent and in contact with the topmost wet wipe in the second clip. Although the present invention should not be limited by any specific theory of operation, the adhesion level between the bottommost z-folded wet wipe in the first clip and the topmost wet wipe of the second clip can be increased by increasing the surface area of the bottom portion on the bottommost z-folded wet wipe in the first clip. Increasing the surface area of the bottom portion of the bottommost wipe also increases the adhesion between the last wet wipe in a stack and the surface on which the stack is resting (for example, the tub or other packaging containing the stack).

All publications, patents, and patent document cited in the present specification are incorporated by reference herein, as though individually incorporated by reference. In the case of any inconsistencies, the present disclosure, including any definitions herein will prevail.

The present invention has been described with reference to various specific and preferred embodiments and techniques. However, it should be understood that many variations and modifications may be made while remaining within the spirit and scope of the invention, which is defined according to the claims appended hereto.

What is claimed is:

1. A clip of z-folded wet wipes, wherein each wet wipe comprises a top portion having a surface area, a central portion having a surface area, and a bottom portion having a surface area, and wherein the clip comprises:

a last z-folded wet wipe positioned at a bottom of the clip, the last z-folded wet wipe comprising a last z-folded wet wipe bottom portion having a last z-folded wet wipe bottom portion surface area, the last z-folded wet wipe top portion having a last z-folded wet wipe top portion surface area, the last z-folded wet wipe bottom portion surface area is greater than the last z-folded wet wipe top portion surface area;

a next-to-last z-folded wet wipe positioned on top of the last z-folded wet wipe, the next-to-last z-folded wet wipe comprising a next-to-last z-folded wet wipe top portion having a next-to-last z-folded wet wipe top portion surface area greater than next-to-last z-folded wet wipe bottom portion surface area; and a plurality of adjacent z-folded wet wipes positioned on top of the next-to-last z-folded wet wipe, each of the plurality of adjacent wet wipes positioned directly adjacent to at least one other of the plurality of adjacent z-folded wet wipes, and each of the plurality of adjacent z-folded wet wipes is folded in substantially the same manner as each other adjacent z-folded wet wipe.

2. The clip of wet wipes according to claim 1, wherein the plurality of adjacent z-folded wet wipes each comprise an adjacent z-folded wet wipe top portion and an adjacent z-folded wet wipe bottom portion, and an adjacent z-folded wet wipe central portion, the adjacent z-folded wet wipe top portion and adjacent z-folded wet wipe bottom portion having adjacent z-folded wet wipe top portion and bottom portion surface areas that are about 50 percent of an adjacent z-folded wet wipe central portion surface area of the adjacent z-folded wet wipe central portion.

3. The clip of wet wipes according to claim 1, wherein the last z-folded wet wipe bottom portion surface area is greater than about 55 percent of a last z-folded wet wipe central portion surface area and the last z-folded wet wipe top portion surface area is less than about 45 percent of the last z-folded wet wipe central portion surface area.

4. The clip of wet wipes according to claim 1, wherein the last z-folded wet wipe bottom portion surface area is greater than about 65 percent of a last z-folded wet wipe central portion surface area and the last z-folded wet wipe top portion surface area is less than about 35 percent of the last z-folded wet wipe central portion surface area.

5. The clip of wet wipes according to claim 1, wherein the last z-folded wet wipe bottom portion surface area is about 75 percent of a last z-folded wet wipe central portion surface area and the last z-folded wet wipe top portion surface area is about 25 percent of the last z-folded wet wipe central portion surface area.

6. The clip of wet wipes according to claim 1, wherein the next-to-last z-folded wet wipe bottom portion surface area is less than about 45 percent of a next-to-last z-folded wet wipe central portion surface area and the next-to-last z-folded wet wipe top portion surface area is greater than about 55 percent of the next-to-last z-folded wet wipe central portion surface area.

7. The clip of wet wipes according to claim 1, wherein the next-to-last z-folded wet wipe bottom portion surface area is less than about 35 percent of a next-to-last z-folded wet wipe central portion surface area and the next-to-last z-folded wet wipe top portion surface area is greater than about 65 percent of the next-to-last z-folded wet wipe central portion surface area.

8. The clip of wet wipes according to claim 1, wherein the next-to-last z-folded wet wipe bottom portion surface area is about 25 percent of a next-to-last z-folded wet wipe's central portion surface area and the next-to-last z-folded wet wipe top portion surface area is about 75 percent of a next-to-last z-folded wet wipe central portion surface area.

9. The clip of wet wipes according to claim 1, wherein a last z-folded wet wipe bottom portion width is greater than about 55 percent of a last z-folded wet wipe central portion width, and a last z-folded wet wipe top portion width is less than about 45 percent of the last z-folded wet wipe central portion width, and wherein the next-to-last z-folded wet wipe has a next-to-last z-folded wet wipe bottom portion width that is less than about 45 percent of a next-to-last z-folded wet wipe central portion width and a next-to-last z-folded wet wipe top portion width that is greater than about 55 percent of the next-to-last z-folded wet wipe central portion width.

10. The clip of wet wipes according to claim 1, wherein a last z-folded wet wipe bottom portion width is greater than about 65 percent of a last z-folded wet wipe central portion width, and a last z-folded wet wipe top portion width is less than about 35 percent of the last z-folded wet wipe central portion width, and wherein the next-to-last z-folded wet wipe has a next-to-last z-folded wet wipe bottom portion width that is less than about 35 percent of a next-to-last z-folded wet wipe central portion width and a next-to-last z-folded wet wipe top portion width that is greater than about 65 percent of the next-to-last z-folded wet wipe central portion width.

11. The clip of wet wipes according to claim 1, wherein a last z-folded wet wipe bottom portion width is about 75 percent of a last z-folded wet wipe central portion width, and a last z-folded wet wipe top portion width is about 25 percent of the last z-folded wet wipe central portion width, and wherein the next-to-last z-folded wet wipe has a next-to-last z-folded wet wipe bottom portion width that is about 25 percent of a next-to-last z-folded wet wipe central portion width and a next-to-last z-folded wet wipe top portion width that is about 75 percent of the next-to-last z-folded wet wipe central portion width.

12. A stack of wet wipes, comprising:

a first clip of wet wipes; and a second clip of wet wipes positioned on top of the first clip of wet wipes, wherein the second clip of wet wipes comprises: a last z-folded wet wipe positioned at a bottom of the second clip, the last z-folded wet wipe comprising a last z-folded wet wipe bottom portion and a last z-folded wet wipe top portion each having a surface area, the last z-folded bottom portion surface area is greater than the last z-folded wet wipe top portion surface area; a next-to-last z-folded wet wipe positioned on top of the last z-folded wet wipe, the next-to-last z-folded wet wipe comprising a next-to-last z-folded wet wipe top portion and a next-to-last z-folded wet wipe bottom portion each having a surface area, the next-to-last z-folded wet wipe top portion surface area is greater than the next-to-last z-folded wet wipe bottom portion surface area; and a plurality of adjacent z-folded wet wipes positioned on top of the next-to-last z-folded wet wipe, each of the plurality of adjacent wet wipes is disposed directly adjacent to at least one other of the plurality of adjacent wet wipes, and each of the plurality of adjacent z-folded wet wipes is folded in substantially the same manner as each other.

13. The stack of wet wipes according to claim 12, wherein each of the plurality of adjacent z-folded wet wipes comprise an adjacent z-folded wet wipe top portion, an adjacent z-folded wet wipe bottom portion, and an adjacent z-folded wet wipe central portion each having surface areas, wherein the adjacent z-folded wet wipe top portion surface area and the adjacent z-folded wet wipe bottom portion surface area of each adjacent z-folded wet wipe are about 50 percent of the adjacent z-folded wet wipe central portion surface area.

14. The stack of wet wipes according to claim 12, wherein the last z-folded wet wipe bottom portion surface area is greater than about 55 percent of a last z-folded wet wipe central portion surface area and the last z-folded wet wipe top portion surface area is less than about 45 percent of the last z-folded wet wipe central portion surface area.

15. The stack of wet wipes according to claim 12, wherein the last z-folded wet wipe bottom portion surface area is greater than about 65 percent of a last z-folded wet wipe central portion surface area and the last z-folded wet wipe top portion surface area is less than about 35 percent of the last z-folded wet wipe central portion surface area.

16. The stack of wet wipes according to claim 12, wherein the last z-folded wet wipe bottom portion surface area is about 75 percent of a last z-folded wet wipe central portion surface area and the last z-folded wet wipe top portion surface area is about 25 percent of the last z-folded wet wipe central portion surface area.

17. The stack of wet wipes according to claim 12, wherein the next-to-last z-folded wet wipe bottom portion surface area is less than about 45 percent of a next-to-last z-folded wet wipe central portion surface area and the next-to-last z-folded wet wipe top portion surface area is greater than about 55 percent of the next-to-last z-folded wet wipe's central portion surface area.

18. The stack of wet wipes according to claim 12, wherein the next-to-last z-folded wet wipe bottom portion surface area is less than about 35 percent of a next-to-last z-folded wet wipe central portion surface area and the next-to-last z-folded wet wipe top portion surface area is greater than about 65 percent of the next-to-last z-folded wet wipe central portion surface area.

19. The stack of wet wipes according to claim 12, wherein the next-to-last z-folded wet wipe bottom portion surface area is about 25 percent of a next-to-last z-folded wet wipe central portion surface area and the next-to-last z-folded wet wipe top portion surface area is about 75 percent of the next-to-last z-folded wet wipe's central portion surface area.

20. The stack of wet wipes according to claim 12, wherein a last z-folded wet wipe bottom portion width is greater than about 55 percent of a last z-folded wet wipe central portion width, and a last z-folded wet wipe top portion width is less than about 45 percent of the last z-folded wet wipe central portion width, and wherein the next-to-last z-folded wet wipe has a next-to-last z-folded wet wipe bottom portion width that is less than about 45 percent of a next-to-last z-folded wet wipe central portion width and a next-to-last z-folded wet wipe top portion width that is greater than about 55 percent of the next-to-last z-folded wet wipe central portion width.

21. The stack of wet wipes according to claim 12, wherein a last z-folded wet wipe bottom portion width is greater than about 65 percent of a last z-folded wet wipe central portion width, and a last z-folded wet wipe top portion width is less than about 35 percent of the last z-folded wet wipe central portion width, and wherein the next-to-last z-folded wet wipe has a next-to-last z-folded wet wipe bottom portion width that is less than about 35 percent of a next-to-last z-folded wet wipe central portion width and a next-to-last z-folded wet wipe top portion width that is greater than about 65 percent of the next-to-last z-folded wet wipe central portion width.

22. The stack of wet wipes according to claim 12, wherein a last z-folded wet wipe bottom portion width is about 75 percent of a last z-folded wet wipe central portion width, and a last z-folded wet wipe top portion width is about 25 percent of the last z-folded wet wipe central portion width, and wherein the next-to-last z-folded wet wipe has a next-to-last z-folded wet wipe bottom portion width that is about 25 percent of a next-to-last z-folded wet wipe central portion width and a next-to-last z-folded wet wipe top portion width that is about 75 percent of the next-to-last z-folded wet wipe central portion width.

23. A stack of z-folded wet wipes, wherein each wet wipe comprises a top portion, a central portion, and a bottom portion each having a surface area, and wherein the stack comprises:

a first plurality of adjacent z-folded wet wipes disposed directly adjacent to one another, each of the first plurality of wet wipes folded in substantially the same manner as each other of the first plurality of adjacent z-folded wet wipes;

a first z-folded wet wipe positioned on top of the plurality of z-folded wet wipes, where the first z-folded wet wipe bottom portion surface area is greater than the first z-folded wet wipe top portion surface area;

a second z-folded wet wipe positioned on top of the first z-folded wet wipe, where the second z-folded wet wipe top portion surface area is greater than the second z-folded wet wipe bottom portion surface area; and a second plurality of adjacent z-folded wet wipes, each of the second plurality of wet wipes folded in substantially the same manner as each other of the second plurality of adjacent z-folded wet wipes.

24. The stack of wet wipes according to claim 23, wherein each first plurality z-folded wet wipe top portion surface area and each second plurality z-folded wet wipe top portion surface area are about 50 percent of the first plurality z-folded wet wipe central portion surface area and second plurality z-folded wet wipe central portion surface area, respectively.

25. The stack of wet wipes according to claim 23, wherein the first z-folded wet wipe bottom portion surface area is greater than about 55 percent of the surface area of a first z-folded wet wipe central portion surface area and the first z-folded wet wipe top portion surface area is less than about 45 percent of the first z-folded wet wipe central portion surface area.

26. The stack of wet wipes according to claim 23, wherein the first z-folded wet wipe bottom portion surface area is greater than about 65 percent of the first z-folded wet wipe central portion surface area and the first z-folded wet wipe top portion surface area is less than about 35 percent of the first z-folded wet wipe central portion surface area.

27. The stack of wet wipes according to claim 23, wherein the first z-folded wet wipe bottom portion surface area is about 75 percent of the first z-folded wet wipe central portion surface area and the first z-folded wet wipe top portion surface area is about 25 percent of the first z-folded wet wipe central portion surface area.

28. The stack of wet wipes according to claim 23, wherein the second z-folded wet wipe bottom portion surface area is less than about 45 percent of the second z-folded wet wipe central portion surface area and the second z-folded wet wipe top portion surface area is greater than about 55 percent of the second z-folded wet wipe central portion surface area.

29. The stack of wet wipes according to claim 23, wherein the second z-folded wet wipe bottom portion surface area is less than about 35 percent of the second z-folded wet wipe central portion surface area and the second z-folded wet wipe top portion surface area is greater than about 65 percent of the second z-folded wet wipe central portion surface area.

30. The stack of wet wipes according to claim 23, wherein the second z-folded wet wipe bottom portion surface area is about 25 percent of the second z-folded wet wipe central portion surface area and the second z-folded wet wipe top portion surface area is about 75 percent of the second z-folded wet wipe central portion surface area.

31. The stack of wet wipes according to claim 23, wherein the first z-folded wet wipe bottom portion surface area is greater than about 55 percent of the first z-folded wet wipe central portion surface area and the first z-folded wet wipe top portion surface area is less than about 45 percent of the first z-folded wet wipe central portion surface area, and wherein the second z-folded wet wipe bottom portion surface area is less than about 45 percent of the second z-folded wet wipe central portion surface area and the second z-folded wet wipe top portion surface area is greater than about 55 percent of the second z-folded wet wipe central portion surface area.

32. The stack of wet wipes according to claim 23, wherein the first z-folded wet wipe bottom portion surface area is greater than about 65 percent of the first z-folded wet wipe central portion surface area and the first z-folded wet wipe top portion surface area is less than about 35 percent of the first z-folded wet wipe central portion surface area, and wherein the second z-folded wet wipe bottom portion surface area is less than about 35 percent of the second z-folded wet wipe central portion surface area and the second z-folded wet wipe top portion surface area is greater than about 65 percent of the second z-folded wet wipe central portion surface area.

33. The stack of wet wipes according to claim 23, wherein the first z-folded wet wipe bottom portion surface area is about 75 percent of the first z-folded wet wipe central portion surface area and the first z-folded wet wipe top portion surface area is about 25 percent of the first z-folded wet wipe central portion surface area, and wherein the second z-folded wet wipe bottom portion surface area is about 25 percent of the second z-folded wet wipe central portion surface area and the second z-folded wet wipe top portion surface area is about 75 percent of the second z-folded wet wipe central portion surface area.

* * * * *